US009962958B2

(12) United States Patent
Kanada et al.

(10) Patent No.: US 9,962,958 B2
(45) Date of Patent: May 8, 2018

(54) DROPLET DISCHARGE APPARATUS

(71) Applicant: SEIKO EPSON CORPORATION, Tokyo (JP)

(72) Inventors: Hidemasa Kanada, Matsumoto (JP); Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/375,897

(22) Filed: Dec. 12, 2016

(65) Prior Publication Data

US 2017/0165980 A1 Jun. 15, 2017

(30) Foreign Application Priority Data

Dec. 15, 2015 (JP) ..... 2015-243864

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 2/17593; B41J 2/01; B41J 11/002
See application file for complete search history.

(56) References Cited

U.S. PATENT DOCUMENTS 8,534,825 B2 * 9/2013 Leighton ..... B41J 2/17593 347/102
2012/0176435 A1 7/2012 Yamanobe

FOREIGN PATENT DOCUMENTS

| | | |
|---|---|---|
| JP | 11-115175 | 4/1999 |
| JP | 2005 343170 A | 12/2005 |
| JP | 2006 056126 A | 3/2006 |
| JP | 2010 125834 A | 6/2010 |
| WO | 2014/012599 A1 | 1/2014 |

OTHER PUBLICATIONS

European Search Report for Application No. 16204163.6 dated May 17, 2017.

* cited by examiner

*Primary Examiner* — Lamson Nguyen
(74) *Attorney, Agent, or Firm* — Workman Nydegger

(57) ABSTRACT

A droplet discharge apparatus includes a recording section that performs recording by discharging ink droplets onto a recording medium, and a drying section including a plurality of drying units that perform drying of the recording medium on which ink droplets have been impacted, wherein the drying units are movably disposed in a predetermined drying area in which the drying of the recording medium is performed.

6 Claims, 4 Drawing Sheets

DROPLET DISCHARGE APPARATUS

BACKGROUND

1. Technical Field

The present invention relates to a droplet discharge apparatus provided with a drying function of a recording medium.

2. Related Art

To date, a droplet discharge apparatus (for example, an ink jet printer) provided with a recording section (for example, an ink jet head) that performs recording (printing) on a recording medium (for example, printing paper) by discharging droplets (for example, ink), and a drying section (for example, a heater) that performs drying of the discharged droplet is known. As such a droplet discharge apparatus, JP-A-11-115175 discloses an ink jet printer that includes a plurality of heaters that are divided in the direction perpendicular to the transport direction of the recording medium, and is provided with a control mechanism that turns on or off the plurality of heaters in accordance with the state of the printing (recording).

However, there has been a problem with the ink jet printer disclosed in JP-A-11-115175 in that it is not possible to effectively utilize a plurality of heaters. Specifically, although it is possible to turn on or off the plurality of heaters depending on the printing state, the positions at which individual heaters are disposed are fixed, and thus it is not possible to easily change the positions. Accordingly, there has been a problem in that it is not possible to effectively use heaters which have been turned off.

SUMMARY

An advantage of some aspects of the invention is that it is possible to realize the following applications or modes.

First Application

According to a first application of the invention, there is provided a droplet discharge apparatus including a recording section that performs recording by discharging droplets onto a recording medium; and a drying section including a plurality of drying units that performs drying of the recording medium to which the droplets have been discharged, wherein the drying units are movably disposed in a predetermined drying area in which the drying of the recording medium is performed.

With this application, a plurality of drying units are movably disposed in a predetermined drying area in which the recording medium is subjected to drying, and thus it is possible to easily dispose the drying units at a more suitable positions in accordance with the position of the recording medium. As a result, it is possible to efficiently use the drying units.

Second Application

The droplet discharge apparatus according to the above application may further include a control section that individually drive controls the plurality of drying units.

With this application, the droplet discharge apparatus includes a control section that individually drive controls the plurality of drying units, and thus it is possible to effectively drive the drying units that are disposed at more suitable positions in accordance with the position of the recording medium.

Third Application

The droplet discharge apparatus according to the above application may further include a transport section that transports the recording medium in a first direction in the drying area, wherein the drying units are movably disposed in a second direction that intersects the first direction.

With this application, the drying units are movably disposed in the second direction that intersects the first direction in which the recording medium is transported in the drying area, and thus it is possible to move the drying units in accordance with the position of the recording medium in the second direction, which is transported in the drying area, or in accordance with the position of the drying in the second direction with respect to the recording medium that is transported in the drying area. As a result, it is possible to perform the drying of the recording medium more effectively and efficiently.

Fourth Application

The droplet discharge apparatus according to the above application may further include a plurality of guiding members that guide the drying units to move across both ends of the drying area in the second direction.

With this application, a plurality of guiding members that guide the drying units to move across both ends of the drying area in the second direction are provided, and thus it is possible to dispose the plurality of drying units in order in the first direction for the recording medium that is transported in the first direction in the drying area. As a result, it is possible to perform the drying more effectively and efficiently.

Fifth Application

In the droplet discharge apparatus according to the above application, the plurality of drying units may include drying units having different lengths in the second direction in which the individual drying units perform drying.

With this application, the plurality of drying units include drying units having different lengths in the second direction in which the individual drying units perform drying, and thus when the plurality of drying units are disposed in order in the first direction for the recording medium that is transported in the first direction in the drying area, it is possible to dispose the individual drying units such that the outer edges of the areas that are subjected to the drying do not overlap each other. As a result, it is possible to prevent the occurrence of drying unevenness.

Sixth Application

In the droplet discharge apparatus according to the above application, the transport section may transport a plurality of the recording media that are arranged in the second direction in parallel with the first direction.

With this application, the transport section transports a plurality of the recording media that are arranged in the second direction in parallel with the first direction. Whereas the plurality of drying units are movably disposed in the second direction that intersects the first direction, and thus it is possible to dispose the drying units in accordance with the positions of the individual recording media in the second direction.

Seventh Application

The droplet discharge apparatus according to the above application may further include a drive section that moves the drying units in the second direction, wherein the control section controls the drive section on the basis of positional information of the recording medium in the second direction in the drying area.

With this application, the droplet discharge apparatus may include a drive section that moves the drying units in the second direction, and the control section controls the drying units on the basis of the positional information of the recording medium in the second direction in the drying area. Accordingly, it is possible to automatically dispose the drying units at suitable positions even if the position of the recording medium is changed.

BRIEF DESCRIPTION OF THE DRAWINGS

The invention will be described with reference to the accompanying drawings, wherein like numbers reference like elements.

DESCRIPTION OF EXEMPLARY EMBODIMENTS

In the following, descriptions will be given of embodiments that are produced by realizing the invention with reference to the drawings. The following is an embodiment of the invention, and does not limit the invention. In this regard, in the following drawings, in order to make the descriptions easy to understand, the descriptions are sometimes given using a scale that is different from the reality. Also, it is assumed that in the coordinates that accompany the drawings, the Z-axis direction is the vertical direction, the +Z-direction is the up direction, the Y-axis direction is the forward and backward direction, the +Y-direction is the forward direction, the X-axis direction is the right and left direction, the +X-direction is the left direction, and the X-Y plane is the horizontal plane. In this regard, in the following descriptions, even if expressions, such as perpendicular, parallel, constant, and the like that are originally understood strictly are used, they do not have only the strict meanings of perpendicular, parallel, constant, respectively and include some degree of error that is allowed for the performance of the apparatus and some degree of error that occurs at the time of manufacturing the apparatus.

First Embodiment

Figure 1:
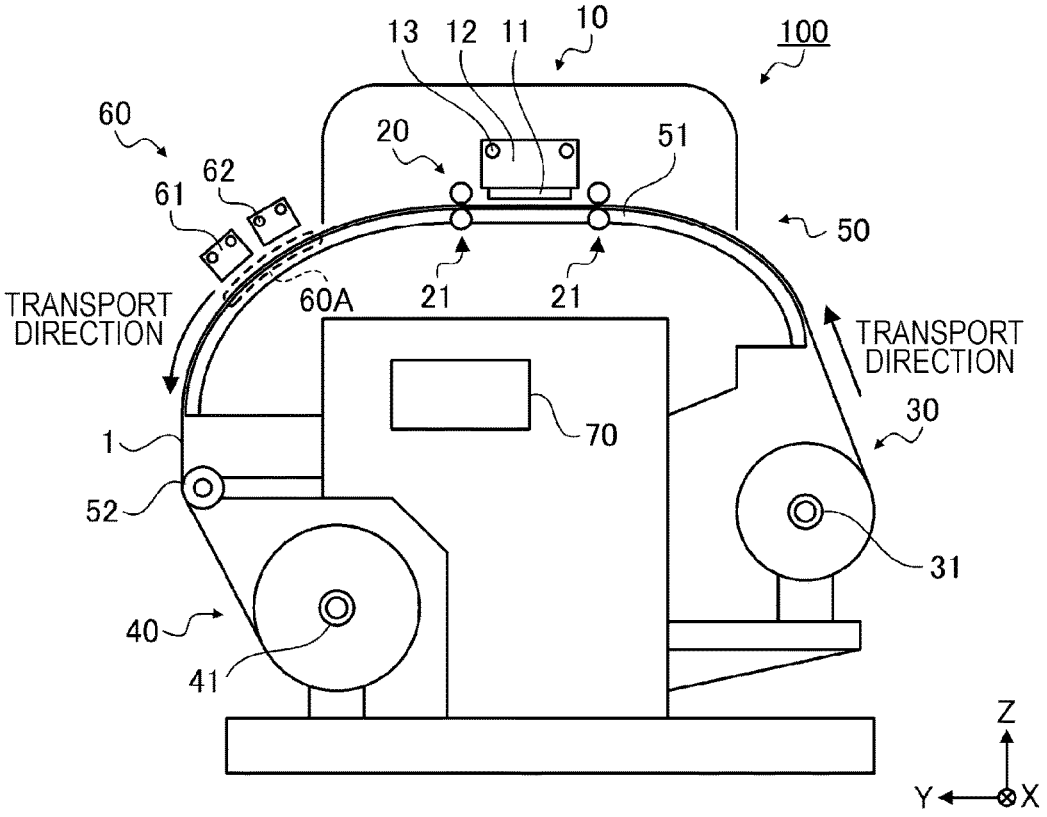
FIG. 1 is a side view schematically illustrating a printer as a droplet discharge apparatus according to a first embodiment.
Figure 2:
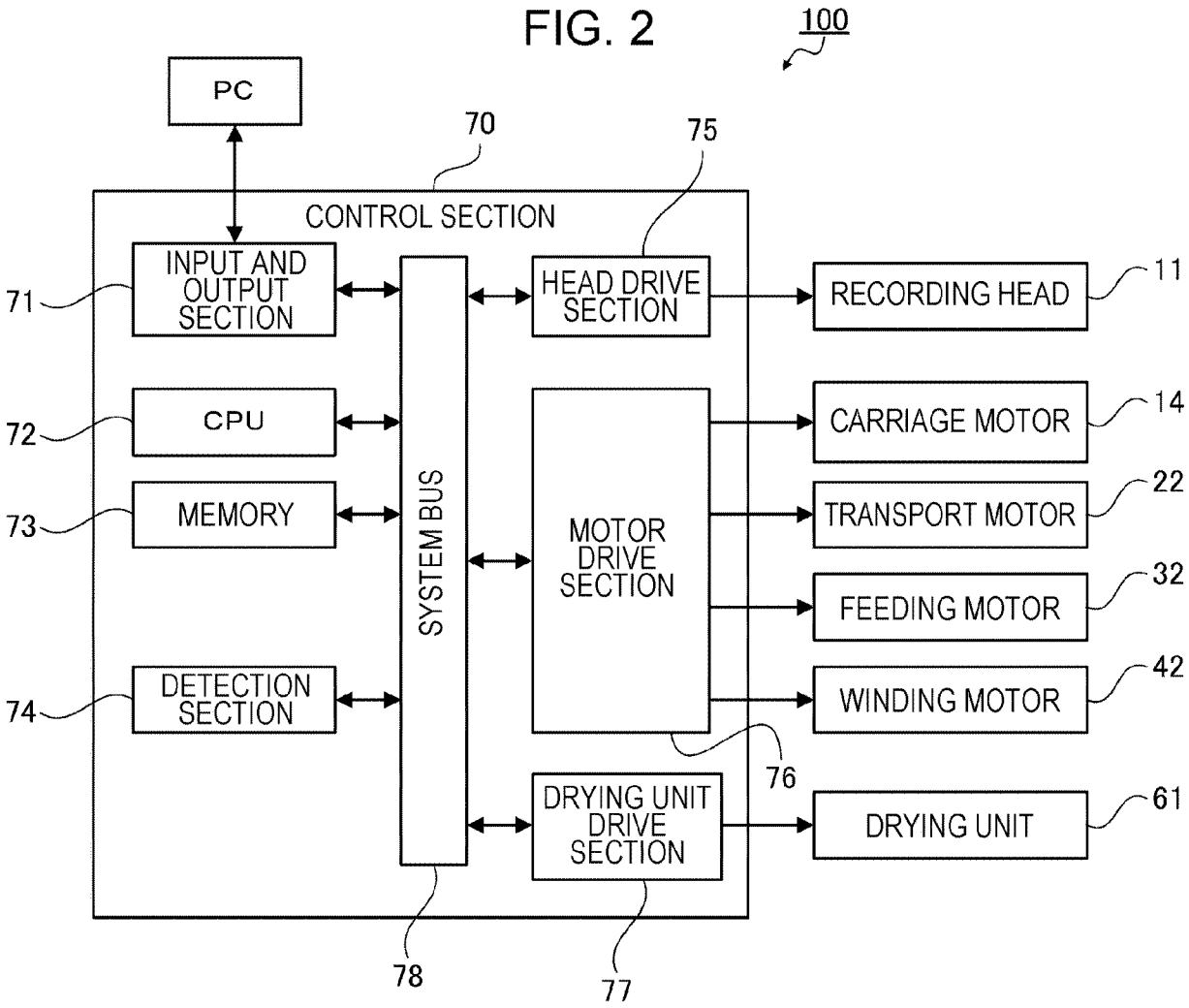
FIG. 2 is a block diagram of the printer.

FIG. 1 is a side view schematically illustrating a printer 100 as a "droplet discharge apparatus" according to a first embodiment. Also, FIG. 2 is a block diagram of the printer 100. The printer 100 is a multi-roll ink jet printer in which a plurality of rolls of rolled paper 1 that is supplied in a roll state as a "recording medium" are allowed to be set in parallel, and images are allowed to be recorded (printed) on the plurality of rolls of the rolled paper 1. The printer 100 includes a recording section 10, a transport section 20, a supply section 30, a winding section 40, a transport path 50, a drying section 60, a control section 70, and the like.

The rolled paper 1 is supplied from the supply section 30, is transported along the transport path 50 via the recording section 10 in accordance with recording, and is stored in the winding section 40. For the rolled paper 1, it is possible to use, for example, high quality paper, cast paper, art paper, coated paper, synthetic paper. Also, it is possible to use a film, or the like that is made from polyethylene terephthalate (PET), polypropylene (PP), or the like.

The recording section 10 includes a recording head 11, a carriage 12, a guide shaft 13, and the like. The recording head 11 is an ink jet head provided with a plurality of nozzles that discharge ink droplets as "droplets". The guide shaft 13 extends in the scanning direction (the X-axis direction in FIG. 1 and is the same direction as the "second direction" of the invention), which intersects the transport direction as the "first direction" in which the rolled paper 1 moves. The carriage 12 is mounted with the recording head 11, and performs reciprocating movement (scanning movement) along the guide shaft 13 by a carriage motor 14 (refer to FIG. 2) under the drive control of the control section 70.

The control section 70 alternately repeats a discharge operation of ink droplets from the recording head 11 while moving the carriage 12 in the scanning direction, and a transport operation by the transport section 20 of moving the rolled paper 1 in the transport direction so as to form (record) a desired image on the rolled paper 1.

In this regard, in this embodiment, the recording section 10 has a configuration including a serial head that performs reciprocating movement in the scanning direction. However, the recording section 10 may have a configuration including a line head in which ink discharging nozzles are arranged in the direction perpendicular to the transport direction over the range in which the rolled paper 1 can be set. Further, the droplet discharge apparatus may be a droplet discharge apparatus including a recording section other than a so-called an ink jet recording head.

The transport section 20 is a transport mechanism that moves the rolled paper 1 in the transport direction in the recording section 10, and includes a drive roller 21 with a nip roller, and the like. The rolled paper 1 is transported by driving the drive roller 21 in a state in which the rolled paper 1 is sandwiched between the drive roller 21 and the nip roller. The drive roller 21 is driven by a transport motor 22 (refer to FIG. 2) under the drive control of the control section 70. In this regard, the transport section 20 is not limited to be configured by these rollers, and may be configured by a transport belt, or the like, for example.

The supply section 30 is an accommodation section that accommodates the rolled paper 1 before being subjected to recording. The supply section 30 is located at the upstream side of the recording section 10 in the transport path 50, and includes a feeding shaft 31, and the like. The feeding shaft 31 is rotated by a feeding motor 32 (refer to FIG. 2) under the drive control of the control section 70, and feeds the rolled paper 1, which has been set, to the recording section 10 disposed at the downstream side of the supply section 30.

The winding section 40 is a storage section that winds the rolled paper 1 on which the recording has completed and stores the rolled paper 1 in a roll state. The winding section 40 is located at the downstream side of the recording section 10 in the transport path 50, and includes a winding shaft 41, and the like. The winding shaft 41 is a rotational axis that is rotated by a winding motor 42 (refer to FIG. 2) under the drive control of the control section 70, and the rolled paper 1, which has been sent via the recording section 10, is wound around the rotational axis as an axis center.

The transport path 50 is a transport path on which the rolled paper 1 is transported from the supply section 30 to the winding section 40 via the recording section 10. The transport path 50 includes a medium support section 51 including a platen that supports the rolled paper 1 in the recording area of the recording section 10, a rotational bar member 52, and the like. The rotational bar member 52 extends over the range in the width direction of the rolled paper 1 in which the rolled paper 1 can be set between the downstream side end of the transport path included in the medium support section 51 and the winding section 40. The rotational axis of the rotational bar member 52 is fixedly supported by the main body of the printer 100. The rotational bar member 52 is rotated with the movement of the rolled paper 1 which is in contact with the rotational bar member 52 so as to support movement of the rolled paper 1.

The drying section 60 is a part that performs drying of the rolled paper 1 on which recording has been carried out (that is to say, ink droplets have been impacted), and is located at the downstream side of the recording section 10 and at the upstream side of the winding section 40 in the transport path 50. The drying section 60 includes a plurality of drying units 61. The drying units 61 include heaters disposed at the positions opposed to the surface, on which droplets have been impacted, of the rolled paper 1 that are transported while being supported by the medium support section 51.

As illustrated in FIG. 2, the control section 70 includes an input and output section 71, a CPU 72, a memory 73, a detection section 74, a head drive section 75, a motor drive section 76, a drying unit drive section 77, a system bus 78, and the like, and performs centralized control of the entire printer 100. The input and output section 71 sends and receives data between an external device (for example, personal computer PC) and the printer 100. The CPU 72 is a processor that performs control of the entire printer 100, and is connected to the input and output section 71, the memory 73, the detection section 74, the head drive section 75, the motor drive section 76, and the drying unit drive section 77 via the system bus 78. The memory 73 is an area in which the programs executed by the CPU 72 are stored, and the necessary information is recorded, and constituted by a memory element, such as a RAM, a ROM, a flash memory, or the like. The CPU 72 controls the head drive section 75, the motor drive section 76, and the drying unit drive section 77 in accordance with the program stored in the memory 73 and a recording job (print instruction) received from the external device.

The detection section 74 includes a plurality of detection device groups (for example, a linear encoder, a rotary encoder, an optical sensor, a temperature sensor, and the like) that are disposed at predetermined places of the inside of the printer 100, such as the recording section 10, the transport section 20, the supply section 30, the winding section 40, the transport path 50, the drying section 60, and the like, and detects (monitors) the operating state of the inside of the printer 100, and outputs the detection result to the control section 70. Specifically, the detection section 74 monitors the position of the carriage 12 that performs scan movement along the guide shaft 13, the setting position of the rolled paper 1 in the width direction of in the transport path 50, the transport state (whether or not the medium is jammed, or the like), whether there is the remaining amount of rolled paper 1, whether there is the remaining amount of ink in the recording section 10, and the like.

Figure 3:
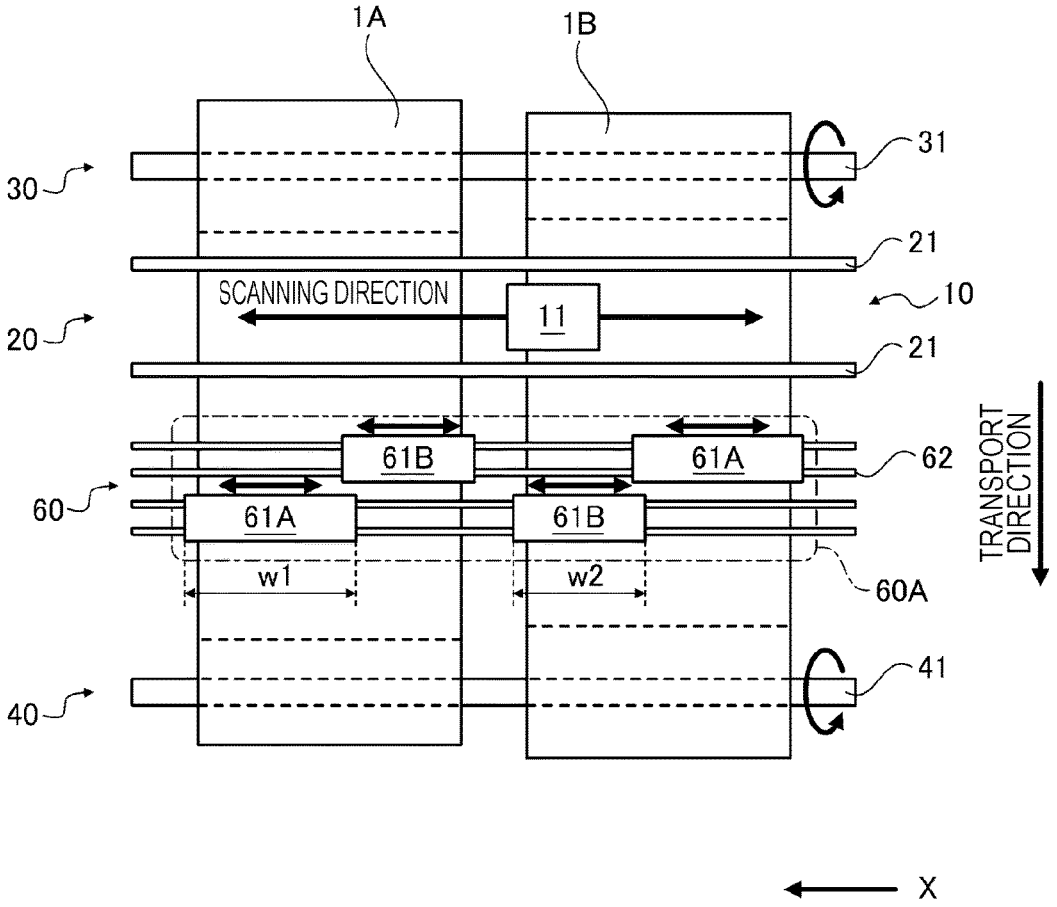
FIG. 3 is a schematic diagram for explaining a disposition and a configuration of a drying section.

FIG. 3 is a schematic diagram for explaining the disposition and the configuration of the drying section 60, which characterizes this embodiment. FIG. 3 illustrates a state in which a path on which the rolled paper 1 is transported from the supply section 30 to the winding section 40 is schematically expanded in the plan view, and two rolls of the rolled paper 1, that is to say, a rolled paper 1A and a rolled paper 1B are set in the transport path 50. In the recording section 10, in order for the recording head 11 to record both on the rolled paper 1A and the rolled paper 1B, the recording section 10 performs scan movement over the individual printing areas of the rolled paper 1A and the rolled paper 1B in the scanning direction. Also, the transport of the rolled paper 1A and the rolled paper 1B is carried out by the transport section 20, the supply section 30, and the winding section 40 in common (at the same time).

The area (hereinafter referred to as a drying area 60A) in which drying is performed by the drying section 60 of the rolled paper 1 (the rolled paper 1A and the rolled paper 1B) is a predetermined area that is subjected to effective drying by the heaters included in the drying units 61 in the rolled paper 1 that is supported by the medium support section 51 at the position on the downstream side of the recording section 10 and on the upstream side of the winding section 40. The "transport section" according to the invention is a transport mechanism that transports the rolled paper 1 in the transport direction as the "first direction" in the drying area 60A in this embodiment, and includes the transport section 20, the supply section 30, the winding section 40, and the transport path 50. The "transport section" constituted by those sections transports a plurality of rolls of rolled paper 1 that are arranged in the "second direction" (the direction intersecting the first direction, and the X-axis direction illustrated in FIG. 1) and in parallel with the transport direction (the first direction).

The drying section 60 includes a plurality of (four in the example illustrated in FIG. 3) drying units 61 and a plurality of (two pairs and four lines in the example in FIG. 3) slide rails 62 as a plurality of "guiding members" that guide the drying unit 61 over both ends of the drying area 60A in the second direction, or the like. The slide rails 62 extend in the second direction and both ends thereof are fixed to the main body of the printer 100 (omitted in FIG. 3), and support the drying unit 61 in a slidably contact state. It is possible to set the drying unit 61 at a suitable position by manually sliding the drying unit 61 so as to match the position of the rolled paper 1 to be subjected to drying in advance.

Each of the drying units 61 includes a heater using a heating resistor, and a reflective plate (omitted in FIG. 3) for effectively irradiating infrared rays emitted by the heater on the rolled paper 1, and the like. Also, for the drying units 61, two kinds of units, namely a drying unit 61A and a drying unit 61B that have different width (length) of the heater in the second direction, and thus have different length (hereinafter referred to as an effective drying width) of performing drying in the second direction with each other are used. Each of the drying units 61 (the drying unit 61A and the drying unit 61B) is subjected to individual drive control of the control section 70. That is to say, the control section 70 controls the drying unit drive section 77 (refer to FIG. 2) so as to make it possible to turn on and off of the individual drying unit 61 and to perform control of the amount of heat generation in the case of turning on.

An effective drying width w1 of the drying unit 61A is longer than an effective drying width w2 of the drying unit 61B. If the effective drying width w2 of the drying unit 61B is used alone, the rolled paper 1 having the minimum width that is handled by the printer 100 is supported. If the effective drying width w1 of the drying unit 61A is used alone, the rolled paper 1 having the width longer than the effective drying width w2 of the drying unit 61B and up to the effective drying width w1 of the drying unit 61A is supported. As illustrated in FIG. 3, two pairs, each of which includes the drying unit 61A and the drying unit 61B, are disposed movably in the second direction by the slide rails 62. That is to say, the drying unit 61B is disposed on the +X side of the near side to the recording section 10 of the slide rails 62, and the drying unit 61A is disposed on the −X side thereof. The drying unit 61A is disposed on the +X side of the near side to the winding section 40 of the slide rails 62, and the drying unit 61B is disposed on the −X side thereof.

In such an arrangement, if two rolls of the rolled paper 1 are set in the printer 100, and the drying unit 61A and the drying unit 61B are suitably moved, it is possible to perform drying on the rolled paper 1 having the width shorter than the effective drying width w2 of the drying unit 61B to the rolled paper 1 having the width equal to the sum of the effective drying width w1 of the drying unit 61A and the effective drying width w2 of the drying unit 61B. Also, if only one roll of the rolled paper 1 is set in the printer 100, it is possible to perform drying on the rolled paper 1 having the width shorter than the effective drying width w2 of the drying unit 61B to the width two times the sum of the effective drying width w1 of the drying unit 61A and the effective drying width w2 of the drying unit 61B.

Figure 4:
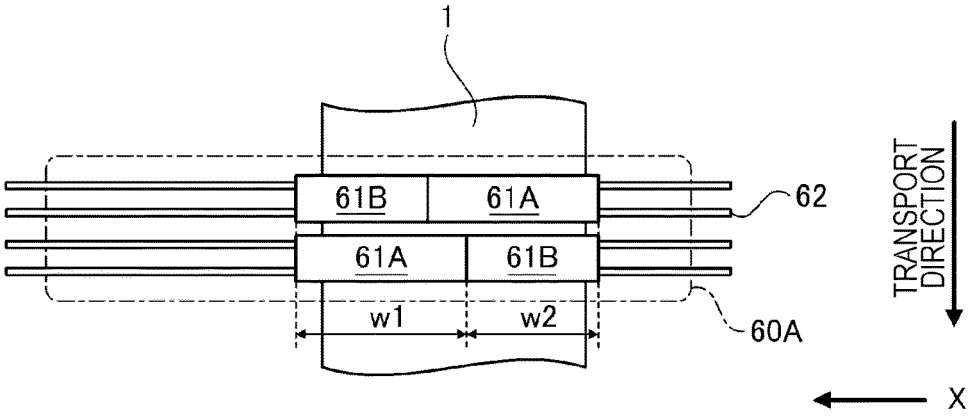
FIG. 4 is a schematic diagram illustrating an example of the disposition of the drying units.

FIG. 4 is a schematic diagram illustrating an example of the disposition of the drying units 61. The drying units 61 (the drying unit 61A and the drying unit 61B) may be disposed as illustrated in FIG. 4, for example. That is to say, when one roll of the rolled paper 1 is set in the printer 100, if the width of the rolled paper 1 is longer than the effective drying width w1 of the drying unit 61A, and is shorter than the sum of the effective drying width w1 of the drying unit 61A and the effective drying width w2 of the drying unit 61B, the drying unit 61A and the drying unit 61B on the same one of the slide rails 62 may be brought close to each other and disposed on the rolled paper 1. In this case, it is worried that the drying capacity of the boundary (the joining part of the outer edges) of the drying unit 61A and the drying unit 61B that are adjacent on the same one of the slide rails 62 might deteriorate. However, the drying unit 61A on another one of the slide rails 62, which has the overlapping position with this boundary in the transport direction (the first direction), expedites the drying, and thus the occurrence of drying unevenness is suppressed by the overlap of the individual boundaries.

As described above, with a droplet discharge apparatus according to this embodiment, the following advantages can be obtained. The plurality of drying units 61 are movably disposed in the predetermined drying area 60A in which drying is performed on the rolled paper 1, and thus it is possible to easily dispose the drying units 61 at more suitable positions in accordance with the position of the rolled paper 1. As a result, it is possible to utilize the drying units 61 more efficiently.

Also, the control section 70 that individually drive controls the plurality of drying units 61 are provided, and thus it is possible to more effectively drive the drying units 61 that are disposed at more suitable positions in accordance with the positions of the rolled paper 1.

Also, the drying units 61 are movably disposed in the second direction that intersects the first direction (the transport direction) in which the rolled paper 1 is transported in the drying area 60A, and thus it is possible to move the drying units 61 in accordance with the position of the rolled paper 1 transported in the drying area 60A in the second direction or in accordance with the position of the drying on the rolled paper 1 transported in the drying area 60A in the second direction. As a result, it is possible to perform drying of the rolled paper 1 more effectively and efficiently.

Also, a plurality of pairs of slide rails 62 that guide the drying units 61 over both ends of the drying area 60A in the second direction are provided, and thus it is possible to arrange a plurality of drying units 61 in the first direction for the rolled paper 1 that is transported in the first direction (the transport direction) in the drying area 60A. As a result, it is possible to perform drying more effectively and efficiently.

Also, a plurality of drying units 61 include the drying units 61 having different lengths in the second direction in which individual drying units 61 perform drying, and thus if a plurality of drying units 61 are disposed in order in the first direction for the rolled paper 1 that is transported in the first direction in the drying area 60A, it is possible to dispose the individual drying units 61 such that the outer edges of the drying areas do not overlap with each other. As a result, it is possible to prevent the occurrence of drying unevenness.

Also, it is possible for the transport section to transport a plurality of rolls of rolled paper 1 that are arranged in the second direction in parallel with the first direction. Meanwhile, a plurality of drying units 61 are movably disposed in the second direction that intersects the first direction, and thus it is possible to dispose the drying units 61 to match the positions of the individual rolls of the rolled paper 1 in the second direction.

In this regard, the invention is not limited to the above-described embodiment, and it is possible to make various changes and improvements of the above-described embodiment, and the like. A description will be given below of a variation. Here, a same reference symbol is used for a same component as that of the embodiment described above, and a duplicated description will be omitted.

First variation

Figure 5:
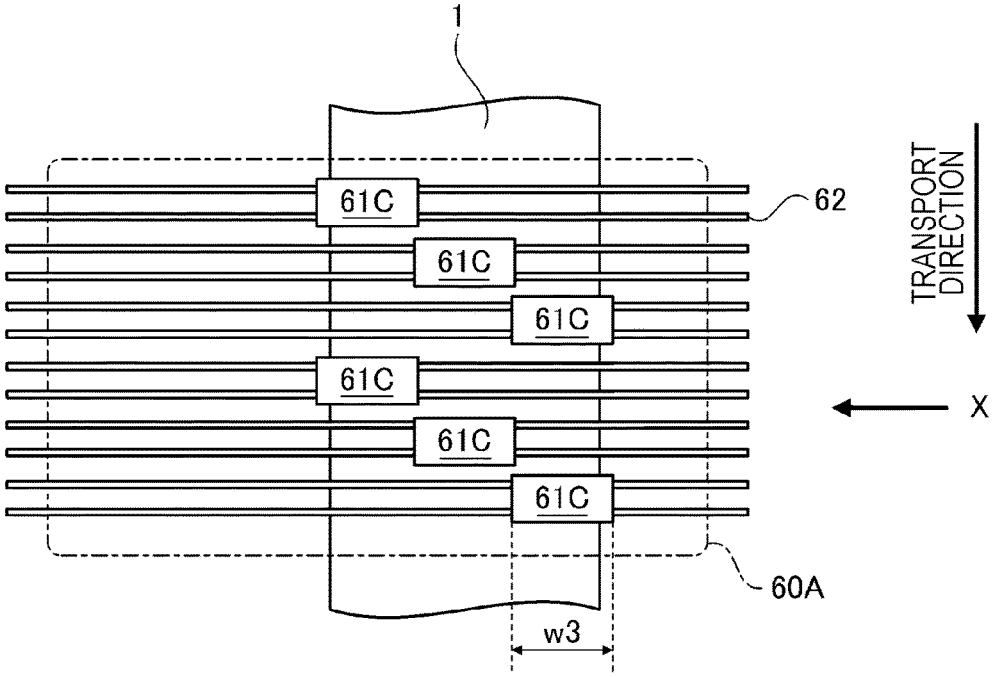
FIG. 5 is a schematic diagram illustrating an example of a configuration of a drying section according to a first variation.

FIG. 5 is a schematic diagram illustrating an example of a configuration of the drying section 60 according to a first variation. As illustrated in FIG. 3, in the first embodiment, the two drying units 61 (the drying unit 61A and the drying unit 61B) are movably disposed on one pair of slide rails 62. However, the invention is not limited to this configuration. For example, only one of the drying units 61 may be movably disposed on one pair of slide rail 62, or three or more drying units 61 may be movably disposed. Also, as illustrated in FIG. 3, in the first embodiment, two pairs of slide rails 62 are provided in the configuration. However, the invention is not limited to this configuration, and a larger number of pairs of slide rails 62 may be provided.

In the example illustrated in FIG. 5, the drying section 60 is provided with six pairs of slide rails 62. Only one drying unit 61C is movably disposed on one pair of slide rails 62. With such a configuration, it is possible to utilize six drying units 61C, and thus for example, an effective drying width w3 of the drying units 61C may be shorter than the effective drying width w2 of the drying units 61B. Also, in this manner, by providing a larger number of the slide rails 62, for example, if the effective drying width w3 of the drying unit 61C covers the width of the rolled paper 1, it becomes possible to perform treatment for giving heat a plurality of times with providing a time difference (treatment, such as preliminary drying, main drying, and the like) on the same rolled paper 1 by selecting the position of the drying unit 61C to be turned on, and to select the time difference.

Second variation

Figure 6:
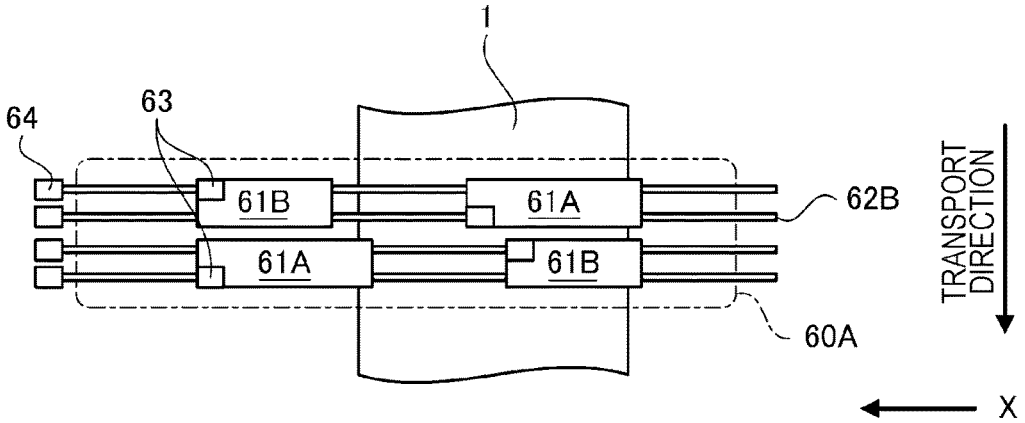
FIG. 6 is a schematic diagram illustrating an example of a configuration of a drying section according to a second variation.

FIG. 6 is a schematic diagram illustrating an example of a configuration of a drying section 60 according to a second variation. In the first embodiment, a description has been given that the drying units 61 are set to suitable positions by manually sliding the drying units 61 to match the position of the rolled paper 1 to be dried in advance. However, the invention may have a configuration provided with a drive section that moves the drying unit 61 in the second direction, and in which the control section 70 controls the drive section on the basis of the positional information of the rolled paper 1 in the second direction in the drying area 60A.

The drying section 60 according to the second variation, which is illustrated in FIG. 6, includes ball screws 62B that are rotationally driven in place of the slide rails 62, and each of the drying units 61 (the drying unit 61A and the drying unit 61B) includes a nut section 63 related to a corresponding one of the ball screws 62B that moves the related one of the drying units 61. The ball screws 62B are rotationally driven by the corresponding drive motors 64 as the "drive section", and the drive motors 64 are subjected to drive control individually by the control section 70. The control section 70 drives the individual drive motors 64 on the basis of the positional information of the rolled paper 1 in the second direction in the drying area 60A, that is to say, on the basis of the information of the size (width) of the rolled paper 1 set in the printer 100 and the set position so as to set the drying unit 61 (the drying unit 61A and the drying unit 61B) at a suitable position. In this manner, even when the position where the rolled paper 1 is set is changed, if the control section 70 recognizes the information, it is possible to automatically dispose the drying unit 61 at a suitable position.

Third variation

In the first embodiment, as illustrated in FIG. 3, a description has been given that a plurality of drying units 61 (the drying unit 61A and the drying unit 61B) are movably disposed in the second direction by the slide rails 62. However, the supporting members that support both ends of the slide rails 62 may be movably configured in the transport direction (the first direction) (omitted to be illustrated in FIG. 3). With such a configuration, it becomes possible to move a plurality of drying units 61 in a plane including the first direction and the second direction in a predetermined drying area 60A in which the rolled paper 1 is dried. That is to say, the degree of freedom of the positions at which the drying units 61 are disposed becomes high.

In this regard, in the above-described embodiment, a description has been given that the drying units 61 include a heater using a heating resistor, a reflective plate for efficiently irradiating infrared rays emitted by the heater on the rolled paper 1, and the like. However, the invention is not limited to this. For example, the invention may include a hot air blower that sends hot air, or an infrared ray lamp. Also, if the printer 100 (the recording section 10) uses ultraviolet ray curable ink, the invention may include an ultraviolet ray irradiation device.

This application claims priority under 35 U.S.C. § 119 to Japanese Patent Application No. 2015-243864, filed Dec. 15, 2015. The entire disclosure of Japanese Patent Application No. 2015-243864 is hereby incorporated herein by reference.

What is claimed is:

1. A droplet discharge apparatus comprising:

a recording section that performs recording by discharging droplets onto a recording medium; and a drying section including a plurality of drying units that perform drying of the recording medium to which the droplets have been discharged, wherein the drying units are movably disposed in a predetermined drying area in which the drying of the recording medium is performed, wherein a transport section transports the recording medium in a first direction in the drying area, and wherein the drying units are movably disposed in a second direction that is perpendicular to the first direction.

2. The droplet discharge apparatus according to claim 1, further comprising a control section that individually drive controls the plurality of drying units.

3. The droplet discharge apparatus according to claim 1, further comprising a plurality of guiding members that guide the drying units to move across both ends of the drying area in the second direction.

4. The droplet discharge apparatus according to claim 1 wherein the plurality of drying units include drying units having different lengths in the second direction in which the individual drying units perform drying.

5. The droplet discharge apparatus according to claim 1 wherein the transport section transports a plurality of the recording media that are arranged in the second direction in parallel with the first direction.

6. The droplet discharge apparatus according to claim 1, further comprising a drive section that moves the drying units in the second direction, wherein the control section controls the drive section on the basis of positional information of the recording medium in the second direction in the drying area.

* * * * *